United States Patent [19]

Lin

[11] Patent Number: 4,869,168

[45] Date of Patent: Sep. 26, 1989

[54] STAMP CARTRIDGE

[76] Inventor: Li-Chuan Lin, No. 14, Kuo-Tai St., Taichung City, Taiwan

[21] Appl. No.: 243,267

[22] Filed: Sep. 12, 1988

[51] Int. Cl.[4] ..... B41B 1/18

[52] U.S. Cl. ..... 101/391; 101/394

[58] Field of Search ..... 101/368, 390–394, 101/402–403; 199/79

[56] References Cited

U.S. PATENT DOCUMENTS

| | | | |
|---|---|---|---|
| 980,959 | 1/1911 | Chalfant | 199/79 |
| 1,533,457 | 4/1925 | Pierpont | 199/79 |
| 1,533,459 | 4/1925 | Pierpont | 199/79 |
| 1,817,142 | 8/1931 | Hehn | 101/391 |
| 1,943,987 | 1/1934 | O'Connell | 101/391 |
| 2,373,966 | 4/1945 | Kohnle | 101/393 |

FOREIGN PATENT DOCUMENTS

| | | | |
|---|---|---|---|
| 304893 | 5/1917 | Austria | 101/391 |
| 373578 | 4/1923 | Fed. Rep. of Germany | 101/394 |
| 6798 | 3/1913 | United Kingdom | 199/79 |

*Primary Examiner*—E. H. Eickholt

*Attorney, Agent, or Firm*—Antonelli, Terry & Wands

[57] ABSTRACT

The present invention is a stamp cartridge comprising a casing having a predetermined number of channels for receiving a plurality of stampers and a holder portion for holding one of the stampers. The closed side of the casing has a plurality of holes opened therein, each hole being correspondent to one of the stampers and allowing one end of each stamper to extend into one of the holes. The end surface of one end of each stamper is flush with the external surface of the closed side of the casing. Alternatively, the end of each stamper is formed as a post which not only extends into one of the holes but also protrudes beyond the same to the outside of the casing. Therefore, the stamper can be pushed out by pressing one end of the stamper moving it along the channel of the the casing.

7 Claims, 3 Drawing Sheets

STAMP CARTRIDGE

BACKGROUND OF THE INVENTION

This invention relates to a stamp cartridge, and more particularly to a stamp cartridge receiving a plurality of stampers, and having a plurality of holes opened thereon, enabling each of said stampers to be pushed out conveniently.

A stamp cartridge of the prior art comprises a rectanglar casing for receiving a plurality of stampers, and a holder formed on one of the sidewalls of said casing so that one of the stampers can be detachably fixed therein for stamping. The advantage of said stamp cartridge is that it receives a plurality of stampers having different stamping surface respectively in a compact container. Therefore, it is convenient to store or carry as well as convenient to use, by means of pulling the desired stamper out of said casing and inserting it into said holder on the stamp cartridge.

A problem arises in the prior art, in that each stamper is detachably fixed within a pair of slots formed in by means of plugging a pair of protrusions, formed on the stamper, into said pair of slots, thereby creating a situation in which each of said stamper, being flat and thin, are closely compacted within the cartridge and very difficult to be gripped by the user, and will usually slip out of his/her grasp.

SUMMARY OF THE INVENTION

The object of the present invention is to provide a stamp cartridge which has a purlarity of holes formed thereon, allowing one end of each stamper to extend into one of said holes so that the stampers received therein can be pushed out respectively.

Accordingly, the stamp cartridge of the present invention comprises: a casing having an opened side and a closed side which is opposite to said opened side, said casing being separated into a plurality of channels which are respectively and linearly extending from said opened side to said closed side; and a plurality of stampers respectively receive within said channels, a first end of each stamper protruding from said open side; wherein said closed side has a plurality of holes opened therein, each hole being correspondent to one of said stampers, allowing a second end of each stamper, which is opposite to said first end, to extend into one of said holes. Consequently, said stampers can be pushed toward said opened side by pressing said second end which extends into said holes, enabling said stampers to easily separate from said stamp cartridge respectively.

BRIEF DESCRIPTION OF DRAWINGS

The invention will now be described by way of example with reference to the accompanying drawings, wherein.

DETAILED DESCRIPTION OF THE PREFERRED EMBODIMENT

Figure 1:
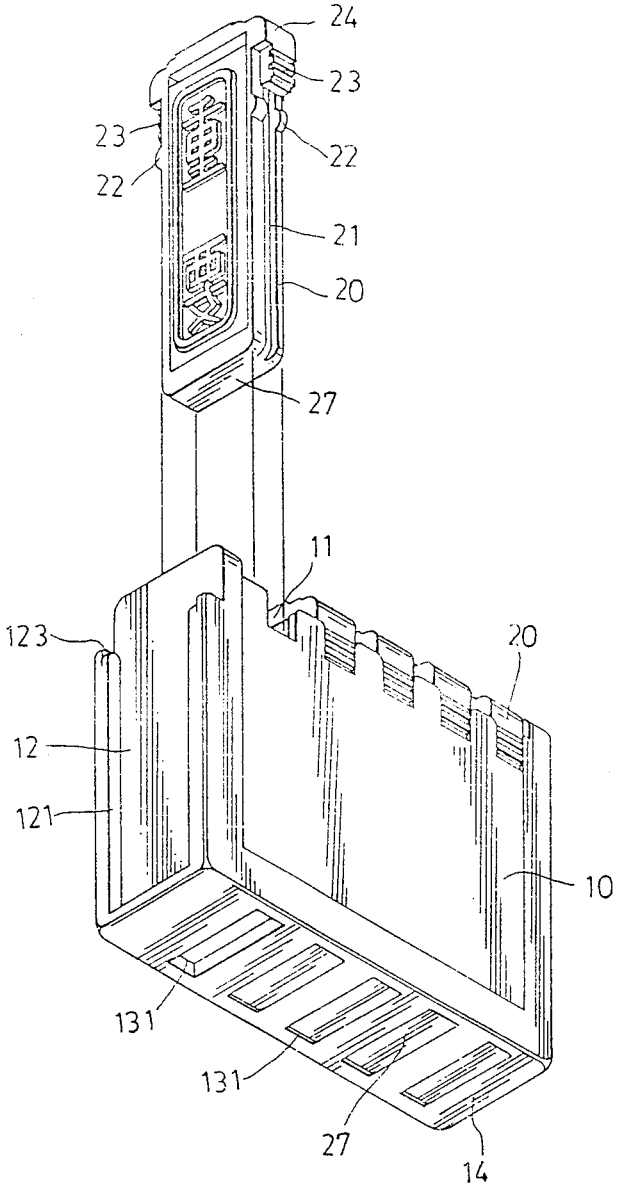
FIG. 1 is a perspective view of a preferred embodiment of a stamp cartridge in accordance with the present invention.
Figure 2:
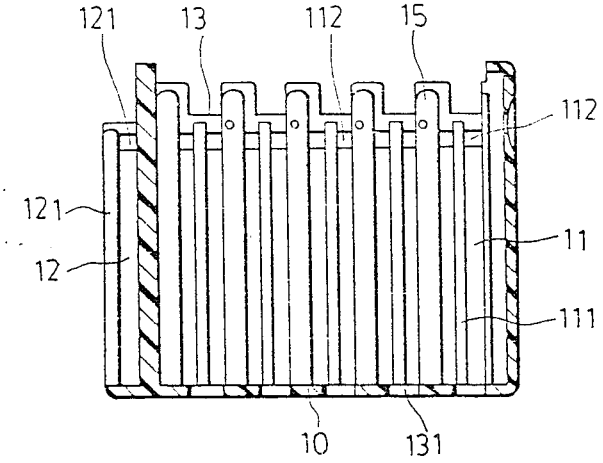
FIG. 2 is a sectional view of a preferred embodiment of a casing of the cartridge in accordance with the present invention.

Referring to FIGS.1 and 2, a preferred embodiment of a stamp cartridge in accordance with the present invention, comprises a flat rectanglar casing 10 having an opened side 13, a closed side 14 which is opposite to said opened side 13 and a plurality of stampers 20 received within said casing 10. Said flat rectanglar casing 10 further comprises a predetermined number of channels 11 for receiving said stampers 20. Said channels 11 as well as said stampers 20 are the same width and parallelly aligned between a pair of narrower sides of said casing 10. A holder portion 12 comprises a "U" shaped rib 123, extended outwardly from the peripheries of a narrower side of said casing 10 and a pair of opposite rails 121, extended inwardly from said two opposite portions of said "U" shaped rib 123, for holding one of said stampers 20. Inner sides of the two opposite portions of said "U" shaped rib 123 of said holder portion 12 have a pair of slots 122 correspondingly formed on a position near the opened side of said holder portion 12. Each of the channels 11 also has a pair of slots 112 correspondingly formed near said opened side 13. A pair of rails 111,111 correspondingly and inwardly protrude from the two opposite walls of each channel 11, linearly extending from a position near said opened side 13 to a position near said closed end 14.

Each stamper has a pair of protrusions 22,22 correspondingly formed near its first end 24. Said pair of protrusions 22,22 of one of said stampers 20 are engaged within said pair of slots 112 of the corresponding channel 11, or said pair of slots 122 of said holder portion 12, for receiving one of said stampers 20.

Each stamper 20 further has a pair of opposite slots 21,21 (one is not shown) formed thereon, linearly extending from the stamper's second end 27 to a position near its first end 24 comprising a pair of handle portions 23, 23 to be gripped by the user, said slots 21, 21 of a certain stamper 20 being correspondent to said pair of rails 111, correspondingly protruded within a channel, for receiving a certain stamper 20, and being correspondent to another said pair of rails 121 correspondingly extended from said pair of ribs 123 of said holder portion 12 for holding a certain stamper 20, enabling each stamper 20 to be guided into a channel 11 or said holder portion 12 and received therein. In this embodiment, a plurality of partition walls 15 are formed between every two channels 11 so as to separate said stampers 20. However, said channels 11, parallelly aligned between two narrower sides of said casing 10, can be connected one by one, i.e. without substantial partition walls 15.

In accordance with the present invention, the stamp cartridge is characterized in that said closed side 14 of said casing 10 has a plurality of holes 131 opened therein, each hole 131 being correspondent to one of said stampers 20, allowing a second end 27 of each stamper 20 to extend into one of said holes 131 until said second ends 27 are flush with the external surface of said closed side 14.

Figure 3:
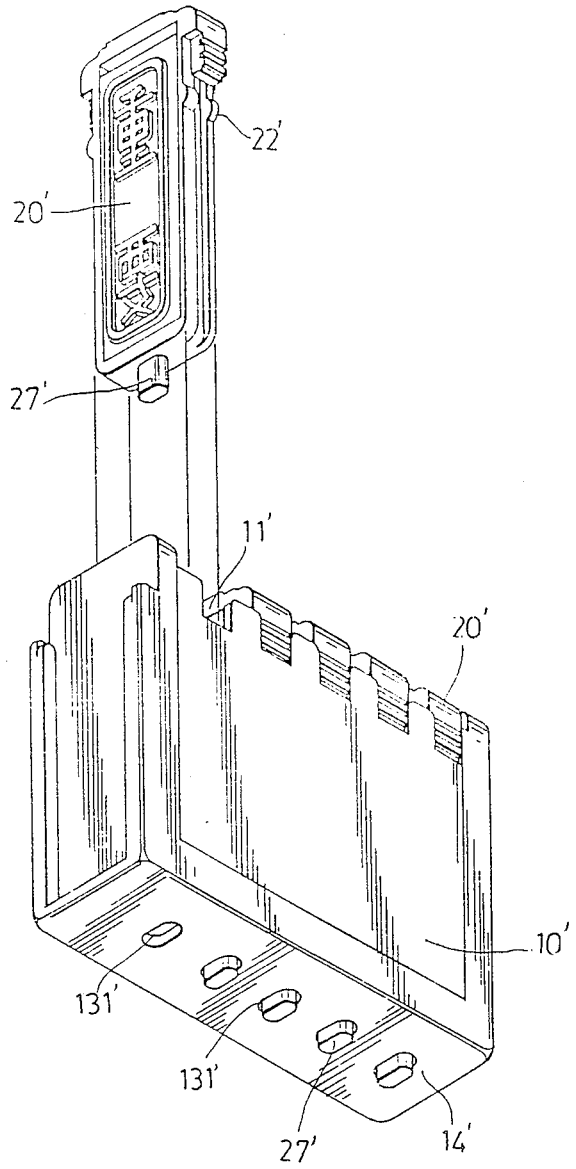
FIG. 3 is a perspective view of another preferred embodiment of a stamp cartridge in accordance with the present invention.

Referring to FIG.3, another preferred embodiment of a stamp cartridge is shown wherein the second end of each stamper 20' is formed as a post 27' which not only extends into one of the holes 131' formed on the closed side 14' of the casing 10' but also protrudes beyond the same to the outside of said casing 10'.

Consequently, said pairs of protrusions 22, 22' of each stamper 20, 20' received in casing 10, 10' are separated from said pairs of slots 112, 112',(not shown in FIG.3), by means of pressing said second end 27, 27' of said stamper 20, 20' so that said stamper 20, 20' will move outwardly along said channels 11, 11'. Therefore, said stamper 20, 20' can be gripped and pulled out stably and easily and then fitted into said holder portion 12 or 12' for stamping purposes.

While several preferred forms of the present invention are herein disclosed, it will be evident to those skilled in the art that various changes and modifications can be made therein without departing from the true spirit of the invention as defined in the appended claims.

I claim:

1. A stamp cartridge comprising: a casing having and opened side, and a closed side which is opposite to said opened side, said casing being separated to a plurality of channels which are respectively and linearly extending from said opened side to said closed side; and a plurality of stampers respectively received within said channels, a first end of each stamper protruding from said open side; wherein said closed side has a plurality of holes opened therein, each hole being correspondent to one of said stampers, allowing a second end of each stamper, which is opposite to said first end, to extend into one of said holes, wherein the end surface of said second ends ar flush with the external surface of said closed side.

2. A stamp cartridge comprising: a casing having an opened side, and a closed side which is opposite to said opened side, said casing being separated to a plurality of channels which are respectively and linearly extending from said opened side to said closed side; and a plurality of stampers respectively received within said channels, a first end of each stamper protruding from said open side; wherein said closed side has a plurality of holes opened therein, each hole being correspondent to one of said stampers, allowing a second end of each stamper, which is opposite to said first end, to extend into one of said holes, wherein said second end of each stamper is formed as a post which not only extends into one of said holes but also protrudes beyond the same to the outside of said casing.

3. A stamp cartridge comprising: a casing having and opened side, and a closed side which is opposite to said opened side, said casing being separated to a plurality of channels which are respectively and linearly extending from said opened side to said closed side; and a plurality of stampers respectively received within said channels, a first end of each stamper protruding from said open side; wherein said closed side has a plurality of holes opened therein, each hole being correspondent to one of said stampers, allowing a second end of each stamper, which is opposite to said first end, to extend into one of said holes, wherein each channel has a pair of opposite walls, said walls having a pair of rails correspondingly and inwardly protruded therefrom within said channel, linearly extending from a position near said opened side to a position near said closed side.

4. A stamp cartridge as claimed in claim 3, wherein each stamper has a pair of opposite slots formed thereon, linearly extending from the stamper's second end to a position near its first end, the slots of a certain stamper being correspondent to the pair of rails correspondingly protruded within a channel for receiving a certain stamper, enabling each stamper to be guided into a channel and received therein.

5. A stamp cartridge as claimed in claim 4, wherein each channel has a pair of slots correspondingly formed near said opened side, and each stamper has a pair of protrusions correspondingly formed near its first end, the pair of protrusions of a certain stamper being engaged with the pair of slots of the correspondent channel for receiving a certain stamper.

6. A stamp cartridge as claimed in claim 5, wherein said casing is flat and rectangular, and which has a pair of opposite broader sides separated by a first pair of opposite narrower sides and a second pair of opposite narrower sides, said opened side and said closed side located in said first pair of opposite narrower sides, where said channels as well as said stampers are of the same width as well as parallelly alligned between said second pair of opposite narrower sides, in addition, one of said second pair of opposite narrower sides further comprises a rib formed along one of the peripheries extending between a position near one of said pair of broader sides and a position near the other of said pair of broader sides, and a pair of opened channels formed along the peripheries extending between a position near said opened side and a position near said closed side, said pair of opened channels adapted to receive any one of said stampers, enabling said stampers to be respectively and detachably fixed therein for stamping purposes.

7. A stamp cartridge as claimed in claim 6, wherein said channels, parallelly aligned between said second pair of opposite narrower sides, are connected (without substantial partition walls).

* * * * *